US007343644B2

(12) United States Patent
Elmer

(10) Patent No.: US 7,343,644 B2
(45) Date of Patent: Mar. 18, 2008

(54) HARDWARE FOR A FULLY-GLAZED DOOR

(75) Inventor: Hubert Elmer, Innsbruck (AT)

(73) Assignee: Dorma GmbH + Co. KG, Ennepetal (DE)

( * ) Notice: Subject to any disclaimer, the term of this patent is extended or adjusted under 35 U.S.C. 154(b) by 19 days.

(21) Appl. No.: 10/553,765

(22) PCT Filed: Oct. 20, 2004

(86) PCT No.: PCT/EP2004/011857

§ 371 (c)(1),
(2), (4) Date: Oct. 19, 2005

(87) PCT Pub. No.: WO2005/040533

PCT Pub. Date: May 6, 2005

(65) Prior Publication Data

US 2006/0265837 A1 Nov. 30, 2006

(30) Foreign Application Priority Data

Oct. 20, 2003 (DE) ..... 203 16 238 U

(51) Int. Cl.
*E05D 7/10* (2006.01)

(52) U.S. Cl. ..... 16/229

(58) Field of Classification Search ..... 16/252, 16/378, 380, 381, 261–264, 229–231; 4/556, 4/557, 607, 614
See application file for complete search history.

(56) References Cited

U.S. PATENT DOCUMENTS 2,184,259 A * 12/1939 Seaman ..... 49/383
2,430,942 A * 11/1947 McGiff ..... 16/229
2,933,756 A * 4/1960 Muessel ..... 16/229
3,468,570 A * 9/1969 Mielke ..... 403/11
3,786,534 A * 1/1974 Ferguson ..... 16/229
4,491,436 A * 1/1985 Easton ..... 403/122
4,620,392 A * 11/1986 Kerpers et al. ..... 16/229
5,150,500 A * 9/1992 Bisbing ..... 16/239
5,483,770 A * 1/1996 Marinoni ..... 16/229
5,490,305 A * 2/1996 Domingo Ribot ..... 16/229

(Continued)

FOREIGN PATENT DOCUMENTS

DE 89 10 569 10/1989

(Continued)

OTHER PUBLICATIONS

International Search Report dated Feb. 8, 2005 issued for International Application No. PCT/EP2004/013515.

*Primary Examiner*—Katherine Mitchell
*Assistant Examiner*—Ruth C. Rodriguez
(74) *Attorney, Agent, or Firm*—Cohen Pontani Lieberman & Pavane LLP

(57) ABSTRACT

A fitting for an all-glass door with an upper bearing which substantially includes a fitting body with a glass receptacle and/or a clamping device for a glass leaf and with a bearing pin for engagement in a counterbearing at an overpanel or in a frame. The bearing pin is displaceable in a pocket hole. To provide a fitting that resists intrusion after the glass door is installed, the bearing pin of the fitting is secured in such a way that the glass leaf is prevented from being lifted out when the all-glass door is closed.

13 Claims, 3 Drawing Sheets

U.S. PATENT DOCUMENTS

| | | | | |
|---|---|---|---|---|
| 5,613,276 | A * | 3/1997 | Franz | 16/229 |
| 5,867,869 | A * | 2/1999 | Garrett et al. | 16/252 |
| 6,070,293 | A * | 6/2000 | Schreiber | 16/229 |
| 6,925,683 | B2 * | 8/2005 | Zebedee | 16/243 |

FOREIGN PATENT DOCUMENTS

| | | | |
|---|---|---|---|
| DE | 298 13 219 | | 11/1998 |
| DE | 299 24 319 | | 10/2002 |
| JP | 02256777 | A * | 10/1990 |

* cited by examiner

HARDWARE FOR A FULLY-GLAZED DOOR

PRIORITY CLAIM

This is a U.S. national stage of application No. PCT/EP2004/011857, filed on 20 Oct. 2004. Priority under 35 U.S.C. §119(a) and 35 U.S.C. §365(b) is claimed from German Application No. 203 16 238.2, filed 20 Oct. 2003.

BACKGROUND OF THE INVENTION

1. Field of the Invention

The invention is directed to a fitting, in particular for all-glass doors, comprising an upper fitting having a fitting body with a clamping device for the glass leaf and with a bearing pin for engaging in a counterbearing at the transom or overpanel.

2. Description of the Related Art

Fittings of the type mentioned above are sufficiently well known. However, the fittings of the upper counterbearing which is supported at an overpanel above the glass leaf of the glass door are generally oriented transverse to the vertical axis of the glass door. DE 299 24 319 U1 discloses a fitting of this type for the rotatable bearing support of a door leaf at a frame construction. In this case, a fitting is arranged at the top and bottom of the door leaf, respectively, and cooperates with a complementary counter-fitting at a frame construction. The fitting is characterized in that a bearing axis extends in the plane of the door leaf and in that the fitting is fastened in a complementary recess of the door leaf. At the same time, the fitting is divided longitudinally by an intermediate space into fitting parts which are spaced apart at least partially so as to form opposite stop faces. The glass pane is fastened by screw members which engage in the fitting from one side. The upper fitting has a nonadjustable bearing pin.

DE 89 105 69.9 U1 discloses an upper bearing element which has a bearing pin that is displaceable in longitudinal direction of the door (vertical axis). This bearing pin is held by a screw that is arranged orthogonal to the bearing pin and can be adjusted in height by loosening this bearing screw. For this purpose, an elongated hole is provided in the fitting part. The bearing pin penetrates into a pocket hole so that when the door is being installed the bearing pin disappears into the pocket hole and, after installing the door, the bearing pin is pressed out of the bearing and penetrates into the counterbearing located at the overpanel. A construction of this kind facilitates mounting of the glass door.

DE 298 13 219 U1 discloses a fitting for an all-glass leaf whose bottom fitting parts are terminated by caps.

It is the object of the present invention to provide a fitting which is resistant to break-in after the glass door is installed.

SUMMARY OF THE INVENTION

This object is met by the inventive upper fitting being provided with lift-out protection by means of a fitting arrangement. The lift-out protection acts in an outwardly inconspicuous manner because it is arranged below the fitting body, or a clamping device, that is terminated by cover caps.

According to an advantageous further development, the bearing pin is fastened to the fitting body and/or to the clamping device for the all-glass leaf by at least one fastening screw. The fastening screw penetrates into or through the bearing pin orthogonal to the center axis of the bearing pin. The fastening screw is inserted into an elongated hole inside the fitting body and/or the clamping device so that the bearing pin is displaceable in direction of the vertical axis. The thread of the fastening screw penetrates into a threaded bore hole within the bearing pin. By tightening the fastening screw when the bearing pin is moved out, this bearing pin is connected to the fitting body and/or to the clamping device in a frictional and positive engagement.

Due to the fact that the bearing pin is located inside a pocket hole, it is possible to introduce another screw element below the moved out bearing pin, which other screw element likewise penetrates the fitting body and/or the clamping device orthogonal to the center axis of the bearing pin. It is not possible to disassemble the installed all-glass leaf when the door is closed because of the arrangement of the safety screw, namely, because the safety screw is arranged so as to be offset by 180° relative to the fastening screw. This can only be done when the safety screw is unscrewed or loosened on one side of the all-glass door and the fastening screw is unscrewed or loosened on the opposite side. However, this means that the fitting and/or the clamping device must be accessible from both sides of the door leaf.

If only the safety screw were removed after removing the cover on one side of the all-glass door, the bearing pin could not be lowered by reason of the design because the fastening screw holds the bearing pin in its position even when the safety screw is removed. This is due to the fact that the fastening screw, which is offset by 180° relative to the safety screw, is accessible within the space in this case. Not until the all-glass door is opened can the fastening screw also be loosened so that the bearing pin can penetrate into the fitting body and/or into the clamping device. However, this is only possible when the safety screw has been completely removed. When the safety screw is removed, the lower part of the pocket hole in which the bearing pin penetrates is released.

If, on the other hand, a person only loosens the fastening screw, the bearing bolt cannot penetrate down into the pocket hole because of the safety screw that is screwed in on the opposite side.

It is clear that such an arrangement of the safety screw and fastening screw of the bearing pin results in a simple yet effective securing of the bearing pin. Adjustability is not impaired by the safety screw when using the glass door. In this regard, it does not matter how the fitting is constructed.

Further details, features and advantages of the invention are indicated in the following description of a preferred embodiment example with reference to the drawings.

BRIEF DESCRIPTION OF THE DRAWINGS

FIG. 2 shows an upper fitting according to FIG. 1 with the bearing pin moved in;

DETAILED DESCRIPTION OF THE PRESENTLY PREFERRED EMBODIMENTS

Figure 1:
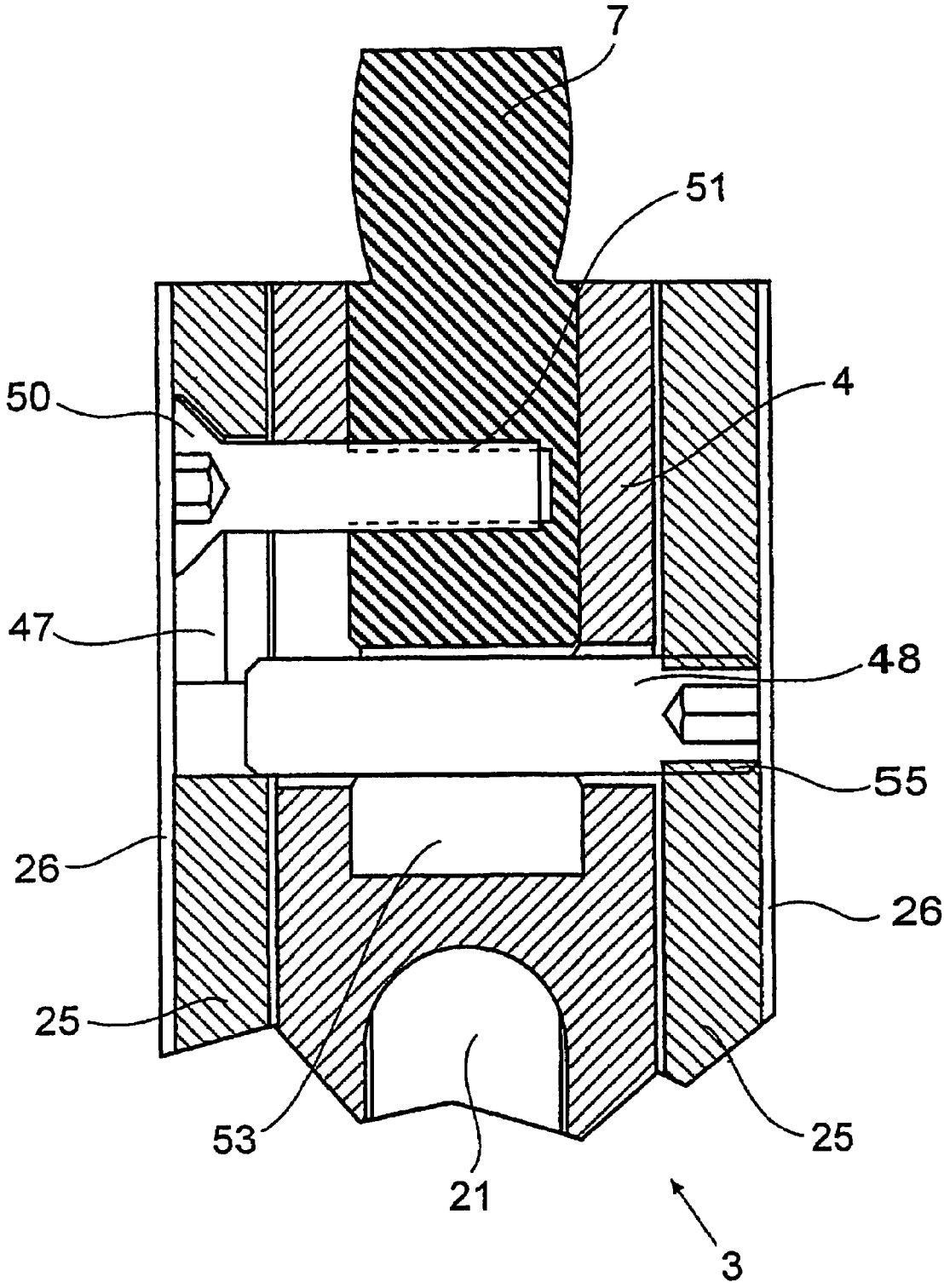
FIG. 1 shows an upper fitting with lift-out protection.

FIG. 1 shows an upper fitting that is used for all-glass doors with a glass leaf. Since the invention is only concerned with the upper area of a fitting that is constructed in different ways and since only the lift-out protection is referred to, all other parts not relevant to the invention have been omitted.

Figure 2:
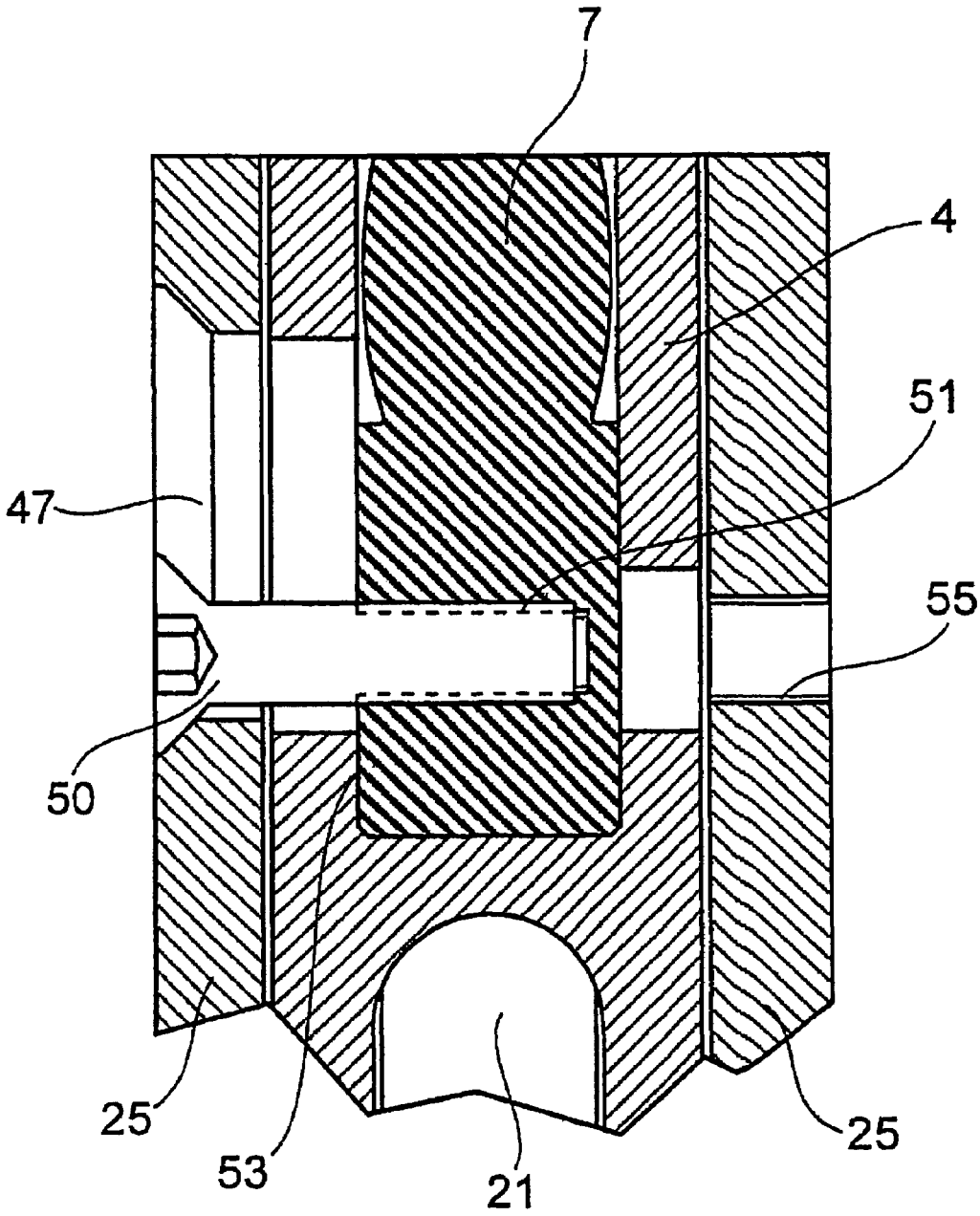
Figure 3:
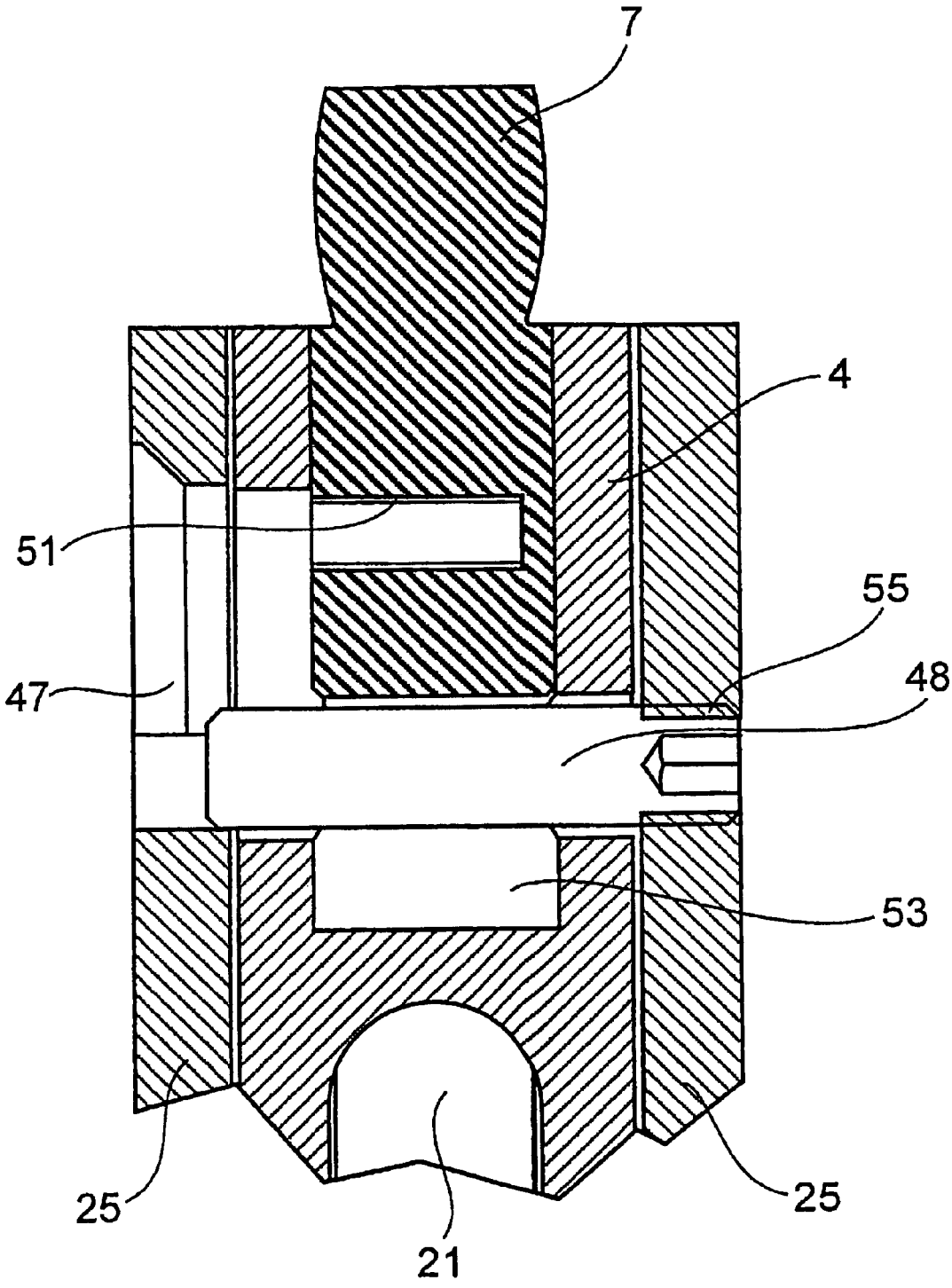
FIG. 3 shows an upper fitting according to FIG. 1 with the fastening screw removed.

The upper fitting 3 substantially comprises a fitting body 4 which has a glass receptacle 21 for the glass leaf of the all-glass door. Located at the upper area of the fitting body 4 is a pocket hole 53 into which a bearing pin 7 of an upper bearing in an overpanel or the like penetrates, this bearing pin 7 being constructed so as to be displaceable. The fitting body 4 is bounded laterally by clamping inserts 25 (clamping plates). The clamping inserts 25 are covered by cover panels 26. When the cover panels 26 are removed, as is illustrated in FIGS. 2 and 3, two screw elements within the upper fitting 3, namely, a holding screw 50 and a safety screw 48, are accessible. The holding screw 50 is fitted with its head in an elongated hole 47 oriented in axial direction and with its thread in an internal thread 51 arranged in the bearing pin 7. When the bearing pin 7 is moved out (see FIG. 1), the holding screw 50 is tightened so that a frictional positive engagement occurs between the bearings pin 7 and the upper fitting 3.

Directly below the end of the bearing pin 7 which penetrates into the pocket hole 53 is a safety screw 48 orthogonal to the longitudinal axis of the fitting. The safety screw 48 penetrates the pocket hole 53. The length of the safety screw 48 is adapted to the thickness of the fitting body and clamping inserts. However, the safety screw 48 is arranged so as to be offset by 180° relative to the holding screw 50. This means that when a door leaf is closed, e.g., the safety screw 48 lies outside of the space and the holding screw 50 is located inside the space. Therefore, when a door is closed no one may simultaneously unscrew both screws, namely, the safety screw 48 and the holding screw 50, in order to lower the bearing pin 7 into the pocket hole 53 so as to remove the door leaf from its working position.

In FIG. 2, the safety screw 48 which was screwed into an internal thread 55 of the clamping insert 25 has been removed. It is clear that loosening the holding screw 50 can cause the bearing pin 7 to be lowered only when the safety screw 48 has been removed beforehand. This is shown in FIG. 2.

FIG. 3 shows the situation in which the holding screw 50 is removed from the bearing pin 7 while the inserted safety screw 48 is present in the thread 55 at the same time.

As can be seen from the embodiment example in FIGS. 1 to 3, a door is also operable compared to the cited prior art according to DE 89 105 60.9 U1 when the holding screw 50 is removed since the bearing pin 7 cannot be pushed out of the upper bearing because of the safety screw 48. Due to the fact that the safety screw 48 is offset by 180° relative to the holding screw 50 when the upper fitting 3 is viewed from the top, the entire all-glass door is also protected from being lifted out at the same time.

The invention claimed is:

1. A fitting for a glass door, the fitting comprising:

a fitting body having a receptacle for a glass leaf and a pocket hole having an axis;

a bearing pin received in the pocket hole, the bearing pin being movable between an extended position, where the bearing pin can engage in a counterbearing of a door frame, and an unextended position, where the bearing pin is substantially within the pocket hole;

a holding screw received in the fitting body and engaging the holding pin; and a safety screw received in said fitting body transversely of said axis and through said pocket hole when said pin is in said extended position, said safety screw preventing said bearing pin from moving from said extended position to said unextended position, wherein said holding screw and said safety screw have respective heads which are accessed from opposite sides of said fitting body.

2. The fitting of claim 1 wherein the holding screw is received in said bearing pin orthogonally of said axis.

3. The fitting of claim 1 wherein said holding screw is threaded into said bearing pin.

4. The fitting of claim 1 wherein the safety screw extends through said pocket hole adjacent to said bearing pin when said bearing pin is in said extended position, and thereby prevents said bearing pin from moving to said unextended position when said holding screw is removed.

5. The fitting of claim 1 further comprising clamping plates arranged on opposite sides of said fitting body.

6. The fitting of claim 5 wherein said safety screw is threaded in one of said clamping plates.

7. The fitting of claim 6 wherein the other of said clamping plates has an elongated hole oriented parallel to said axis and receiving said holding screw therethrough, said elongated hole permitting said bearing pin to move from said extended to said unextended position when said holding screw is loosened and said safety screw is removed.

8. A fitting for a glass door, the fitting comprising:

a fitting body having a receptacle for a glass leaf and a pocket hole having an axis;

a bearing pin received in the pocket hole, the bearing pin being movable between an extended position, where the bearing pin can engage in a counterbearing of a door frame, and an unextended position, where the bearing pin is substantially within the pocket hole;

a holding screw received in the fitting body and engaging the holding pin;

a safety screw received in said fitting body transversely of said axis and through said pocket hole when said pin is in said extended position, said safety screw preventing said bearing pin from moving from said extended position to said unextended position; and clamping plates arranged on opposite sides of said fitting body, wherein said safety screw is threaded in one of said clamping plates.

9. The fitting of claim 8 wherein the holding screw is received in said bearing pin orthogonally of said axis.

10. The fitting of claim 8 wherein said holding screw is threaded into said bearing pin.

11. The fitting of claim 8 wherein the safety screw extends through said pocket hole adjacent to said bearing pin when said bearing pin is in said extended position, and thereby prevents said bearing pin from moving to said unextended position when said holding screw is removed.

12. The fitting of claim 8 wherein said holding screw and said safety screw have respective heads which are accessed from opposite sides of said fitting body.

13. The fitting of claim 8 wherein the other of said clamping plates has an elongated hole oriented parallel to said axis and receiving said holding screw therethrough, said elongated hole permitting said bearing pin to move from said extended position to said unextended position when said holding screw is loosened and said safety screw is removed.

* * * * *